US010680335B2

(12) United States Patent
Bunce et al.

(10) Patent No.: US 10,680,335 B2
(45) Date of Patent: Jun. 9, 2020

(54) RESONANT ANTENNA FOR GENERATING CIRCULARLY-POLARIZED SIGNAL WITH MULTIPLE MODES

(71) Applicant: Ferrite Microwave Technologies LLC, Nashua, NH (US)

(72) Inventors: Graeme Bunce, Londonderry, NH (US); Peter H. Tibbetts, Dublin, NH (US)

(73) Assignee: Ferrite Microwave Technologies LLC, Nashua, NH (US)

( * ) Notice: Subject to any disclaimer, the term of this patent is extended or adjusted under 35 U.S.C. 154(b) by 547 days.

(21) Appl. No.: 15/340,563

(22) Filed: Nov. 1, 2016

(65) Prior Publication Data

US 2018/0123247 A1 May 3, 2018

(51) Int. Cl.

| | |
|---|---|
| ***H05B 6/72*** | (2006.01) |
| ***H05B 6/70*** | (2006.01) |
| ***H01Q 21/24*** | (2006.01) |
| ***H01Q 9/04*** | (2006.01) |
| ***H01Q 21/29*** | (2006.01) |

(Continued)

(52) U.S. Cl.

CPC ..... *H01Q 9/0428* (2013.01); *H01P 1/173* (2013.01); *H01Q 1/36* (2013.01); *H01Q 13/18* (2013.01); *H01Q 21/29* (2013.01); *H05B 6/708* (2013.01); *H05B 6/72* (2013.01)

(58) Field of Classification Search

CPC ..... H01Q 1/36; H01Q 9/0428; H01Q 13/18; H01Q 21/29; H01P 1/173; H05B 6/708; H05B 6/72

USPC ..... 219/748, 746, 747, 750, 745, 695, 696, 219/697; 343/771, 768, 746, 767, 770, 343/783, 786; 333/248, 249

See application file for complete search history.

(56) References Cited

U.S. PATENT DOCUMENTS 3,388,399 A * 6/1968 Lewis ..... G01S 13/4409 343/783
3,668,567 A * 6/1972 Rosen ..... H01P 1/067 333/117

(Continued)

FOREIGN PATENT DOCUMENTS

EP 0 623 970 A1 11/1994

OTHER PUBLICATIONS

International Search Report and Written Opinion for International Application No. PCT/US2017/059178 dated Feb. 6, 2018.

*Primary Examiner* — Quang T Van

(74) *Attorney, Agent, or Firm* — Wolf, Greenfield & Sacks, P.C.

(57) ABSTRACT

A three-dimensional resonant chamber is described. The three-dimensional resonant chamber may support a plurality of circularly polarized modes at a desired frequency. The desired frequency may be in an ISM (Industrial, Scientific, Medical) frequency band, such as in the 902 MHz-928 MHz or in the 2.4 GHz-2.5 GHz. The three-dimensional resonant chamber may include one or more openings for coupling electromagnetic radiation outside the three-dimensional resonant chamber. The three-dimensional resonant chamber may be disposed in a cavity, such as a microwave oven, and may be configured to excite the cavity through the one or more openings. The three-dimensional resonant chamber may be connected to a waveguide support a circularly polarized mode.

20 Claims, 12 Drawing Sheets

(51) Int. Cl.

| | |
|---|---|
| ***H01Q 13/18*** | (2006.01) |
| ***H01P 1/17*** | (2006.01) |
| ***H01Q 1/36*** | (2006.01) |

(56) References Cited

U.S. PATENT DOCUMENTS

| | | | | |
|---|---|---|---|---|
| 4,825,219 | A | 4/1989 | Ajioka | |
| 6,034,362 | A | 3/2000 | Alton | |
| 6,274,858 | B1 | 8/2001 | Alton | |
| 2009/0119981 | A1 | 5/2009 | Drozd et al. | |
| 2009/0295661 | A1 * | 12/2009 | Tzelepis ..... | G01S 3/14 343/786 |

* cited by examiner

RESONANT ANTENNA FOR GENERATING CIRCULARLY-POLARIZED SIGNAL WITH MULTIPLE MODES

BACKGROUND

1. Technical Field

Embodiments of the present invention relate to antennas for exciting a cavity with circularly-polarized energy. More specifically, some embodiments relate to an antenna for generating, based on an input signal with one circularly-polarized mode, an output signal with multiple circularly-polarized modes, and to a system that includes a cavity and such an antenna disposed in the cavity.

2. Discussion of Related Art

Microwave energy may be used in a number of fields, including in industrial or residential food processing, scientific laboratories, or medical therapies. In the context of food processing, microwave energy may be used in drying, in sterilizing or pasteurizing, or in heating or cooking.

SUMMARY

In one embodiment, there is provided an apparatus. The apparatus may comprise a microwave antenna. The microwave antenna may comprise a three-dimensional resonant chamber to generate, from an input microwave signal having a circularly polarized mode, an output microwave signal having a plurality of circularly polarized modes, and at least one aperture, formed on the three-dimensional resonant chamber, to couple the output microwave signal having the plurality of circularly polarized modes to an outside of the three-dimensional resonant chamber.

In another embodiment, there is provided an apparatus. The apparatus may comprise an antenna to be disposed in a cavity and to excite the cavity with an output signal having a plurality of circularly polarized modes, the antenna comprising: a three-dimensional resonant chamber, shaped to support a plurality of circularly polarized modes, to generate the output signal having the plurality of circularly polarized modes from an input signal having a circularly polarized mode, and at least one aperture, formed on the three-dimensional resonant chamber, to couple to the cavity the output signal having the plurality of circularly polarized modes.

In a further embodiment, there is provided an apparatus. The apparatus may comprise a cavity, and an antenna disposed within the cavity to receive an input signal having a circularly polarized mode, the antenna comprising a three-dimensional resonant chamber to generate, based on the input signal, an output signal having a plurality of circularly polarized modes and to couple the output signal to the cavity.

In yet another embodiment, there is provided an apparatus. The apparatus may comprise a waveguide supporting a circularly polarized mode, a three-dimensional resonant chamber to generate an output signal having a plurality of circularly polarized modes from an input signal having the circularly polarized mode, the three-dimensional resonant chamber being electromagnetically coupled to the waveguide to receive from the waveguide the input signal having the circularly polarized mode, and a coupler configured to electromagnetically couple the output signal having the plurality of circularly polarized modes to an outside of the three-dimensional resonant chamber.

In yet another embodiment, there is provided a method. The method may comprise receiving a first signal having a circularly polarized mode, generating, using a three-dimensional resonant chamber and based on the first signal having the circularly polarized mode, a second signal having a plurality of circularly polarized modes, and exciting a non-resonant cavity, in which the three-dimensional resonant chamber is disposed, with the second signal having the plurality of circularly polarized modes.

In yet another embodiment, there is provided an apparatus. The apparatus may comprise an input waveguide, a cavity, and means for, responsive to an input signal having a circularly polarized mode received via the input waveguide, exciting the cavity with an output signal having a plurality of circularly polarized modes, wherein the means for exciting the cavity with the output signal is disposed within the cavity.

The foregoing is a non-limiting summary of the invention, which is defined by the attached claims.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
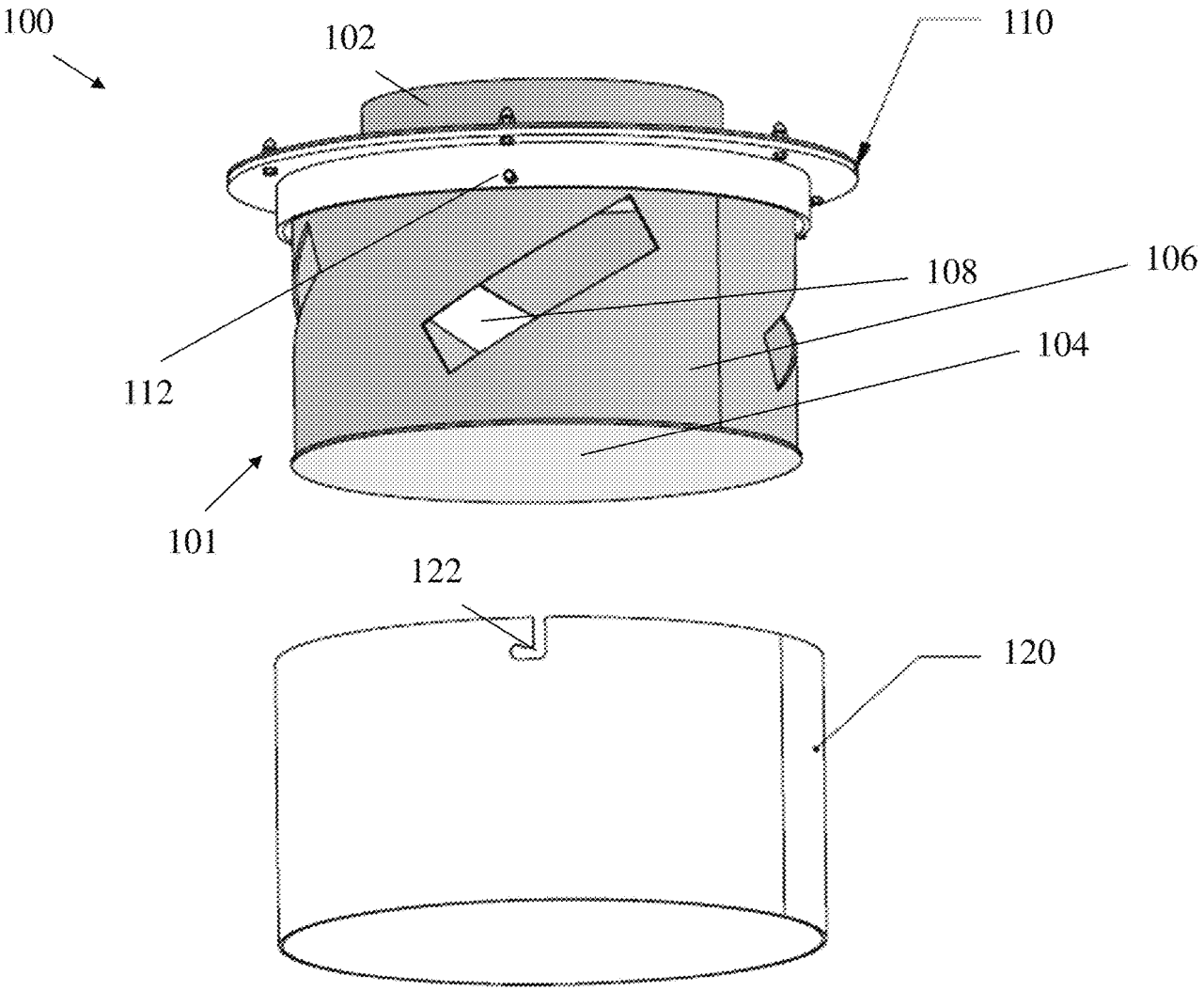
FIG. 1A is an exploded perspective view illustrating a resonant antenna, according to some non-limiting embodiments.

Described herein are embodiments of an antenna that, on application of an input signal having one circularly polarized mode, generates and outputs an output signal having multiple circularly polarized modes. The antenna may include a resonant chamber for generating the output signal having the multiple circularly polarized modes. In some embodiments, the antenna may be arranged for use with a cavity to excite the cavity with the output signal, and may be disposed at least partially in the cavity. The cavity may include a load to which the output signal is to be applied. In a case in which the antenna is a component of a microwave oven, the load may be one or more food items disposed in a cavity of the oven, though it should be appreciated embodiments are not limited to working with microwave ovens or loads that are foods. In some embodiments, the resonant chamber may include one or more features designed to leak resonant energy into the surrounding microwave chamber, such as apertures in a sidewall of the resonant chamber. Such features may increase coupling of the output signal having the multiple circularly polarized modes to an outside of the antenna, including coupling to the cavity in which the resonant antenna is at least partially positioned. In some embodiments, the antenna may be used with microwave signals, such as microwave signals within an ISM (Industrial, Scientific, Medical) frequency band, though it should be appreciated that signals of other frequencies may be used. It should be appreciated that the ISM band may be an ISM band within any suitable jurisdiction, such as an ISM band within the United States of America, an ISM band within one or more European jurisdictions, or any other ISM band. In some cases, such ISM bands may be referred to by other names, but will be understood by those skilled in the art to correspond to frequencies assigned for use by industrial, scientific, medical, or other applications.

The inventors have recognized and appreciated that microwave energy distribution uniformity within microwave chambers, such as microwave ovens or other cavities, may be improved by feeding microwave energy into the microwave chamber using resonant antennas that support at least two circularly polarized modes. Such resonant antennas may radiate microwave energy according to a field distribution that enables the receiving chamber to be excited uniformly, or with increased uniformity, using the multiple circularly polarized modes as compared to conventional antennas that do not emit multiple circularly polarized modes.

Microwave chambers excited with conventional feeders may exhibit non-uniform microwave energy internal distributions. As a result, "cold" and "hot" spots having differing energy levels may arise at various locations within the chamber. Such behavior is often caused by the presence of standing waves within the chamber exciting certain locations of the chamber to a greater extent than others. The presence of these spots may be particularly undesirable with some types of loads that may be placed within the microwave chambers to be processed via the microwave signals. In the case of microwave ovens performing a cooking processing on food, such standing waves may cause some portions of the food to be completely cooked while others may be barely warmed. Undesirable effects of standing waves may arise in other contexts with other types of loads. Resonant antennas of the type described below in connection with some embodiments may promote energy uniformity and limit the formation of standing waves and "cold" and "hot" spots.

The inventors have further recognized and appreciated that using some embodiments of the resonant antennas described herein may additionally limit the amount of microwave energy reflected back from the chamber. The formation of energy reflections may be undesirable in some environments as it may damage components along the microwave path, including the microwave source. In addition, energy reflections may reduce the amount of energy coupled into the microwave chamber, thus reducing the efficiency of the microwave system and increasing its energy consumption. In some embodiments, by exciting the microwave chamber with multiple circularly polarized modes, back reflections are limited. In these cases, circularly polarized modes exhibit a higher degree of matching, compared to linearly polarized modes, with respect to the modes of the microwave chamber.

In some embodiments, a resonant antenna of the type described herein may receive microwave energy in the form of a circularly polarized mode, and in response, may produce a multiple circularly polarized modes. The resonant antenna may include a chamber shaped and configured to support multiple modes, including multiple circularly polarized modes. In some embodiments, such a chamber may be shaped as a cylinder, though those skilled in the art will appreciate that any suitable shape to support multiple modes may be used. In embodiments in which the chamber is shaped as a cylinder, a cylinder of any suitable dimensions may be used. Those skilled in the art will appreciate how to set dimensions of a resonant chamber, such as dimensions of a cylinder, such that the chamber will support desired modes having desired properties.

In some embodiments, the resonant chamber of the resonant antenna may be electrically closed, at least at the frequencies with which the resonant antenna is designed to operate. Those skilled in the art will appreciate that to achieve such electric closure, the material used for the resonant chamber may exhibit a sufficiently high conductivity, at the frequency of the signals, to constrain the electric field of the signal within the resonant chamber. In some embodiments, such material may be solid, or a mesh or screen, or of any other suitable structure that is sufficiently electrically closed to the signals to ensure resonance. In some embodiments, to increase coupling of the output signal with multiple circularly polarized modes to an outside of the antenna, the resonant antenna may additionally include one or more apertures. These apertures may be formed on a sidewall of the antenna, as openings in the material that is electrically closed at the operating frequencies. The apertures may be sized to leak a portion of the resonant microwave energy outside the antenna. In particular, the shape and size of the apertures may be chosen so as to provide enough energy into the microwave chamber, with respect to a specific application, without perturbing the modes of the resonant antenna. In this way, energy uniformity within the chamber may be obtained while at the same time back reflections may be limited. Those skilled in the art will understand how to set the shape and size of the apertures so as to output a desired amount of energy from the resonant antenna without perturbing the modes.

In some embodiments, the resonant antenna may receive an input signal having one circularly polarized mode from a waveguide supporting such a circularly polarized mode. In some such embodiments, the waveguide may include a polarizer to create the circularly polarized mode. For example, the waveguide may include one portion to support a linearly polarized mode, which may include a bend, and may include a second portion that generates from the signal with a linearly polarized mode another signal with the one circularly polarized mode. The signal with the one circularly polarized mode may be applied to the resonant antenna to generate the output signal with the multiple circularly polarized modes.

A "circularly polarized mode" is a mode in which a polarization vector associated with an electric field, and/or a magnetic field, changes direction in a rotary manner. Such a rotary manner may include changing in a symmetrically rotating manner, or a non-symmetrically rotating manner. A circularly polarized mode may include a mode rotating about major and minor axes, and the minor axis and major axis may have non-equivalent lengths. For example, a circularly polarized mode may have a minor axis with a length that is at least 80 percent of the length of the major axis, which might also be referred to as an "elliptically" polarized mode. In embodiments, a minor axis may be more than 90 percent, or more than 95 percent of the length of the major axis.

Those skilled in the art will appreciate, the number of modes supported by a microwave structure, such as a microwave waveguide or a resonant chamber, may depend on the frequency at which the microwave structure is excited. For example, a microwave waveguide may support a single mode at a first frequency, while it may support multiple modes at another frequency. The resonant chambers and waveguides described herein are said to support a certain number of modes. When not specified, such resonant chambers or waveguides are configured to support such number of modes at a frequency within the ISM (Industrial, Scientific, Medical) frequency band, such as in the 902 MHz-928 MHz bandwidth or in the 2.4 GHz-2.5 GHz.

FIG. 1A is a perspective view illustrating an example of a resonant antenna. While some embodiments may implement an antenna in accordance with FIG. 1A, it should be appreciated that embodiments are not so limited, and that other antenna designs may be used consistent with the principles described herein. Resonant antenna 100 includes a three-dimensional resonant chamber 101 (also referred to more simply below as the "resonant chamber" or the "chamber") to generate a signal having multiple circularly polarized modes. Resonant antenna 100 may be formed from a conductive material, e.g., aluminum. In this way, electromagnetic energy may be confined within the chamber 101 of the resonant antenna. In some embodiments, the outer walls of the resonant antenna 100 may be solid. In other embodiments, the outer walls may be shaped to form a conductive mesh. The size and shape of the mesh may be configured to confine electromagnetic energy within the resonant antenna 100.

According to one aspect of the present application, the size and shape of the resonant antenna 100 may be designed to support multiple polarized modes, such as multiple circularly-polarized modes. By supporting multiple modes, the field distribution within the resonant antenna 100 may be more uniform compared to antennas supporting only one mode. In some embodiments, the resonant antenna 100 may support two polarization modes, e.g., a $TE_{11}$-mode and a $TE_{21}$-mode. The two modes may be circularly polarized. In some embodiments, the resonant antenna 100 may have a cylindrical shape, and may include a bottom wall 104, a sidewall 106, and a top wall (not shown in FIG. 1A). The bottom wall 104 may be electrically closed, while the top wall may include an opening for receiving electromagnetic radiation in the antenna, such as receiving from a generator of electromagnetic radiation and/or a waveguide conveying radiation from a source.

According to another aspect of the present application, resonant antenna 100 may be used to radiate electromagnetic energy to regions surrounding the antenna. In some embodiments, the electromagnetic radiation that is confined within the resonant antenna may be allowed to partially leak outside the antenna. Leaking of electromagnetic radiation may be obtained by providing the antenna with one or more apertures.

FIG. 1A illustrates an antenna having a plurality of apertures 108. Apertures 108 may have rectangular shapes, though any other suitable shape may be used, including circular, elliptical, squared, polygonal, or combinations thereof. The aperture(s) may be formed on sidewall 106.

In some embodiments, the length (i.e. the longest side) of an aperture may be approximately equal (e.g., within a 25%, a 10%, a 5%, or a 1% tolerance) to a quarter of the wavelength, at a desired frequency, of the electromagnetic radiation. For example, an antenna operating at 915 MHz may include apertures having a length of approximately 8 cm, while an antenna operating at 2.45 GHz may include apertures having a length of approximately 3 cm.

The number and size of the apertures may be selected to provide a desired trade-off between the power coupled outside the antenna and the energy distribution inside the antenna. On one hand, having larger apertures and/or a large number of apertures may be desirable as more power may be allowed to leak outside the antenna. On the other hand, the apertures may perturb the modes of the antenna. This perturbation may cause the antenna to support modes that differ from the desired modes. For example, while a resonant chamber may have a shape and dimensions designed to support a $TE_{11}$-mode and a $TE_{21}$-mode, the addition of apertures above a certain number or having dimensions above a certain size may cause the resonant chamber to support different modes. For this reason, the geometry of the apertures may selected based on considerations relating to the antenna's requirements and specifications.

In some embodiments, the apertures may be angled, with respect to the plane of bottom wall 104, as illustrated in FIG. 1A. In this way, the apertures may occupy a larger portion of the sidewall while the distance between adjacent apertures may be kept large enough to limit electric breakdown. For example, adjacent apertures may be separated by a distance, on a plane that is parallel to the bottom wall 104, that is between 1 mm and 10 cm, between 1 cm and 10 cm, between 1 cm and 5 cm, or between 1 cm and 3 cm. In some embodiments, the apertures may be slanted, with respect to the plane defined by the bottom wall 104, by an angle that is between 25 degrees and 75 degrees, between 30 degrees and 60 degrees, between 30 degrees and 45 degrees, or between 45 degrees and 60 degrees.

The bottom wall 104 may be fully closed in some embodiments, without any apertures located on the bottom wall 104. In some embodiments, this may aid in prevention of hot spots forming in the vicinity of or co-axially with the bottom wall 104. However, in other embodiments, one or more apertures 108 could be located on the bottom wall 104.

In some embodiments, antenna 100 may receive electromagnetic energy from an opening formed in the top wall. In some embodiments, the antenna may include an inlet 102, as illustrated in FIG. 1A. The inlet 102 may be connected to an input waveguide (not shown in FIG. 1A). The input waveguide may support any suitable number of modes. In one example, the input waveguide may support one circularly polarized mode. When the circularly polarized mode is coupled to antenna 100, the circularly-polarized modes supported by the antenna 100 may be excited. When the circularly-polarized modes of the antenna are excited, the antenna 100 is said to be "resonating." In some circumstances, an antenna 100 of the type described herein may be used to convert electromagnetic radiation having a first number of circularly polarized mode (e.g., a single circularly polarized mode) into electromagnetic radiation having a second number, greater than the first number, of circularly polarized modes (e.g., two or more circularly polarized modes).

In some embodiments, antenna 100 may be placed at least partially inside a cavity. The cavity may be an area of a microwave oven arranged to hold food to be processed (e.g., heated, dried, sterilized or pasteurized, etc.), but it should be appreciated that embodiments are not limited to operating with microwave ovens or with food processing, and may operate in other scientific or industrial applications, or in other contexts. In these embodiments, exciting the cavity through the antenna 100 may result in an enhanced uniformity of the field distribution inside the cavity as compared to directly exciting the cavity with a waveguide. Consequently, the formation of standing waves (and thus the formation of hot/cold spots) may be limited. The cavity may have an opening formed on a sidewall such that inlet 102 passes through the opening.

In some embodiments, the antenna 100 may be arranged to affix to a side of the cavity. For example, the antenna 100 may be arranged to affix to a top surface of the cavity. In some such embodiments, flange 110 may be used to attach antenna 100 to the surface of the cavity and to electromagnetically seal the antenna. In such embodiments, the inlet 102 may pass through the opening of the cavity and the flange 110 may be positioned flush with the surface of the cavity.

In some embodiments, the electromagnetic field within antenna 100 may reach powers up to 100 KW. As a result, the outer walls of the antenna may heat up. To avoid direct contact with the outer walls, especially when the temperature of the outer wall may cause damage or harm to operators or loads to be processed with radiation emitted by the antenna, the antenna may be covered with an insulating cover 120. Alternatively, or additionally, the insulating cover may be used to protect the antenna from food items or other loads that may damage or soil the antenna 100. For example, as food items are heated, portions of the food may move around a microwave oven in which the antenna is placed, or foods may occasionally become overheated and explode, which may result in food sticking to an outer surface of the antenna. By using an insulating cover, contact between the food portions and the antenna may be prevented. In some such embodiments, the antenna may include a first latch 110 and the insulating cover may include a second latch 122. The two latches may be shaped and positioned to latch the cover to the antenna, when the cover is placed around the antenna. For example, latch 110 may include a protrusion and latch 122 may include an opening, such as slot having two segments. When the insulating cover 120 covers the antenna, the protrusion may be slid inside the opening. In embodiments that use a cover such as cover 120, the cover may be electrically open at least at frequencies at which the antenna 100 is designed to operate, such that signals emitted by the antenna 100 may pass uninhibited or with low loss through the cover 120.

Figure 1C:
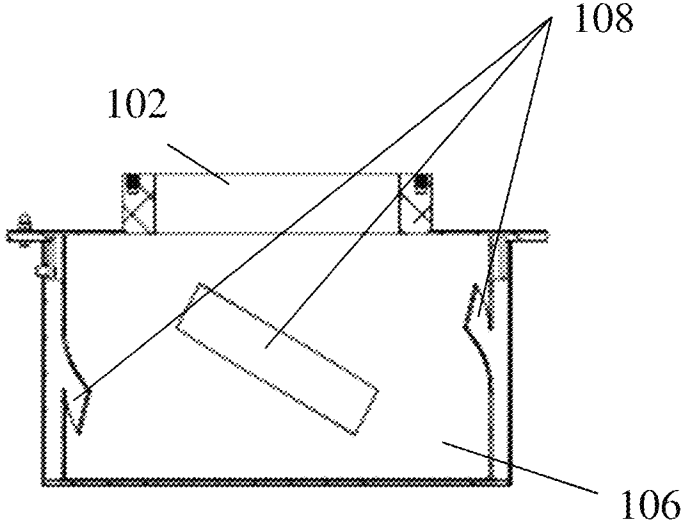
FIG. 1C is a cross-sectional view taken at the line A shown in FIG. 1B, illustrating the resonant antenna of FIG. 1A, according to some non-limiting embodiments.
Figure 1B:
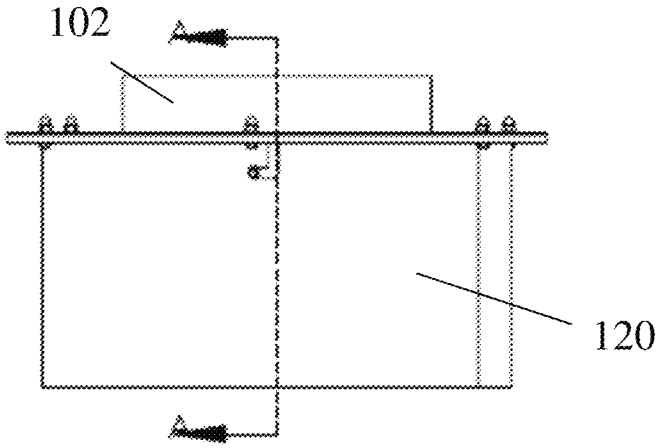
FIG. 1B is a side view illustrating the resonant antenna of FIG. 1A, according to some non-limiting embodiments.

FIG. 1B is a side view illustrating an antenna 100 covered with an insulating cover 120, showing a cross-sectional line A. FIG. 1C is a cross-sectional view, taken at line A of FIG. 1B, illustrating an antenna 100 without the insulating cover. Apertures 108 are illustrated. The apertures 108 may have a shape that conforms to the curved shape of sidewall 106 of resonating antenna 100. While FIG. 1C illustrates rectangularly shaped apertures, other shapes may be used. FIG. 1C further illustrates inlet 102 coupled to the top wall of the resonating antenna. In some embodiments, the inlet 102 may have a cylindrical cross section.

Figure 1D:
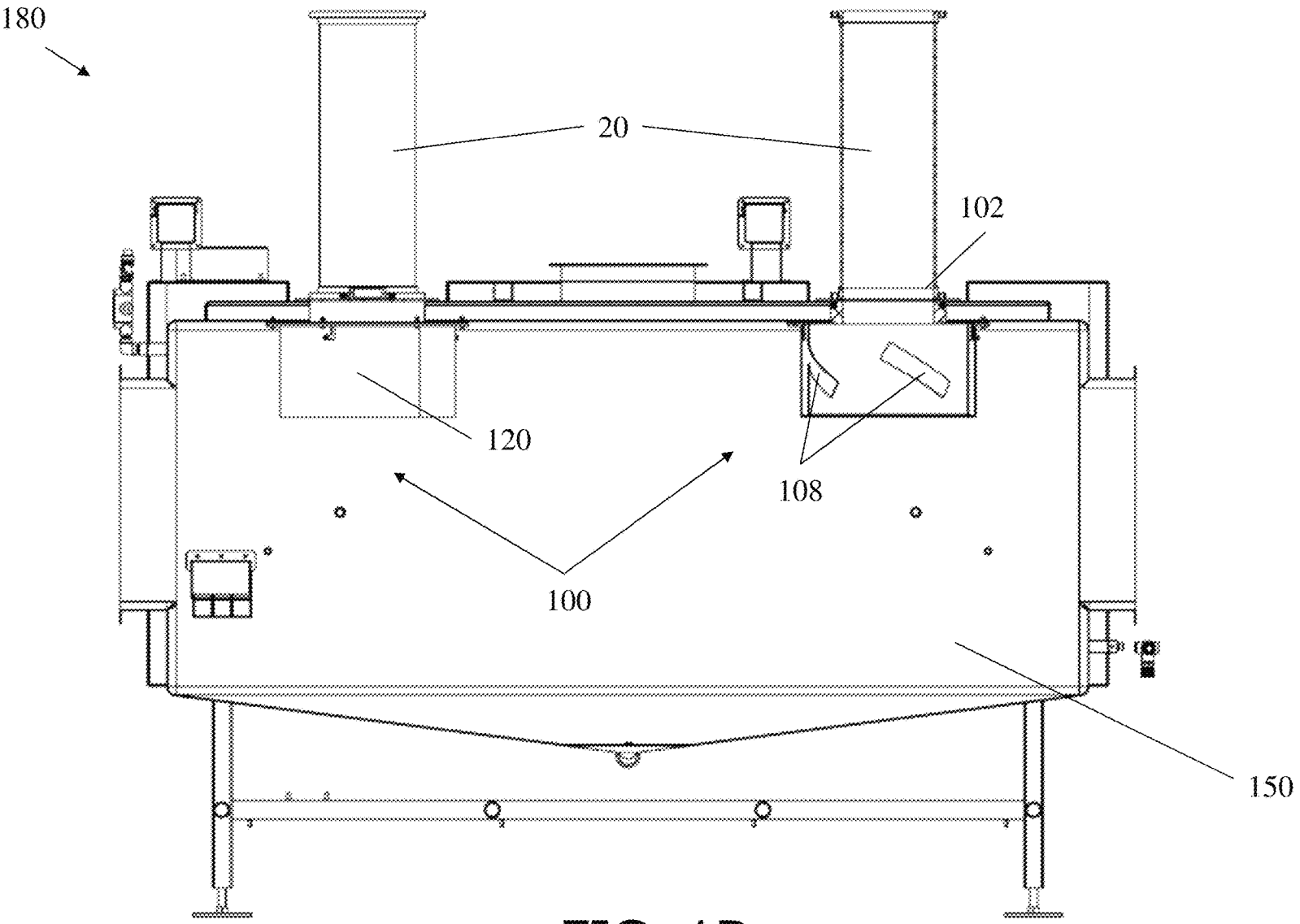
FIG. 1D is a cross-sectional view illustrating the resonant antenna of FIG. 1A disposed within a cavity, according to some non-limiting embodiments.

As described previously, antenna 100 may be used to transfer electromagnetic energy into a cavity. FIG. 1D is a cross-sectional view of a processing apparatus 180 to subject a load to radiation during processing of the load. The load may be positioned with a cavity 150 of the processing apparatus 180. Processing apparatus 180 may be a microwave oven in some embodiments, in which cases food may be positioned within the cavity 150 to be processed via radiation with which the cavity 150 is excited. Cavity 150 may be formed from a conductive material, such as aluminum.

In some embodiments, one or more antennas 100 may be disposed at least partially within the cavity 150. The antennas 100 disposed in the cavity 150 may be structured in accordance with the discussion of antenna embodiments above, in connection with FIGS. 1A-1C. While the figure illustrates two antennas 100, any other suitable number of antennas may be disposed inside a cavity 150 for coupling electromagnetic energy to the cavity 150.

Cavity 150 may contain therein one or more loads, such as food items. The loads may be placed inside the cavity for processing, which in the case of food items may include heating, cooking, drying, sterilizing or pasteurizing, or other food processing. To ensure uniform processing in the cavity, it may be desirable to excite the cavity with a uniform electromagnetic field distribution, or a field distribution with high uniformity or uniformity above a desired level. As should be appreciated from the foregoing, using antennas as described herein may in some embodiments aid in achieving this uniformity or may make the field distribution more uniform than when using other techniques for exciting cavity 150, such as by connecting a waveguide directly to the cavity 150 via an opening in the cavity 150. As illustrated, the cavity 150 may include an opening for receiving a corresponding inlet 102, when an antenna is connected to the cavity 150. Inlet 102 may be connected to input waveguide 20. Flanges 110 may be used to prevent leaking of electromagnetic radiation.

Resonant antennas of the type described herein may be used to reduce the power reflected to the power source. When a resonant antenna is positioned between the power source and the load, differences in the electric impedance along the signal path may be reduced. For example, positioning an antenna between, along the signal path, a feed waveguide and a cavity may result in a reduction of the discontinuity between the electric impedance of the feed waveguide and the electric impedance of the cavity. Consequently, power reflections may be decreased compared to a case in which the feed waveguide is directly connected to the cavity.

Figure 2B:
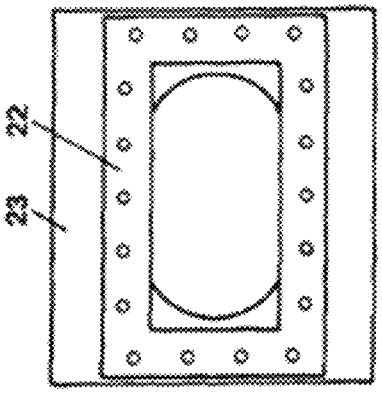
FIG. 2B is a front view illustrating the waveguide of FIG. 2A, according to some non-limiting embodiments.
Figure 2A:
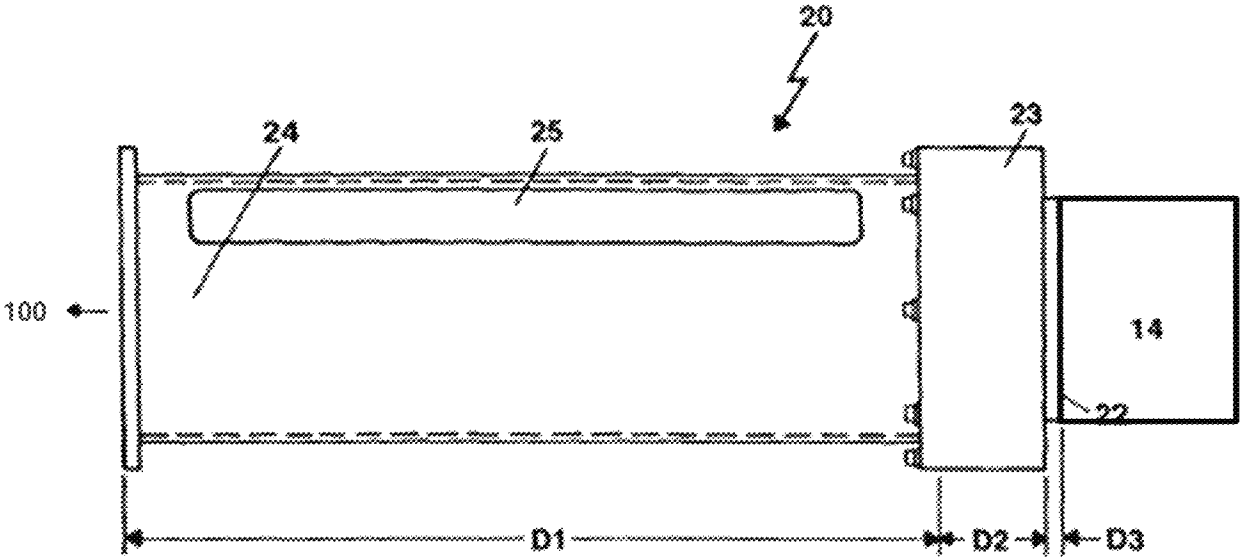
FIG. 2A is a side view illustrating a microwave waveguide, according to some non-limiting embodiments.

In some embodiments, input waveguide 20 supports a circularly polarized mode. A circularly polarized mode may be obtained from a linearly polarized mode in some embodiments. For example, a linearly polarized mode may be decomposed into two orthogonal components, which may be phase shifted from each other to generate a circularly polarized mode. FIG. 2A and FIG. 2B are respectively a side view and a front view of waveguide 20, according to some non-limiting embodiments. Waveguide 20 may be designed to support a circularly polarized mode, and may have a curved cross section, e.g., circular or elliptical. Waveguide 20 may receive electromagnetic energy from waveguide 14, which may support a linearly polarized $TE_{11}$-mode. As seen in FIG. 2A, the waveguide 20 may include flange 22, transformer 23 and section 24. In some embodiments, transformer 23 may mechanically connect waveguides 20 and 14. Section 24 may include element 25, which may be positioned and sized to phase shift a first component of the linearly polarized mode from a second component. FIG. 2B shows an end view of the waveguide 20 taken from the input end which is coupled to the waveguide 14. This figure illustrates flange 22 and a partial view of an interior portion of the transformer 23. In some embodiments, when operated at approximately 915 MHz, waveguide 20 may have a cylindrical sectional length D1 of approximately 30.00 inches (in), transformer 23 may have a length D2 of approximately 4.070 in, and flange 22 may have a thickness D3 of approximately 0.625 in.

Figure 3B:
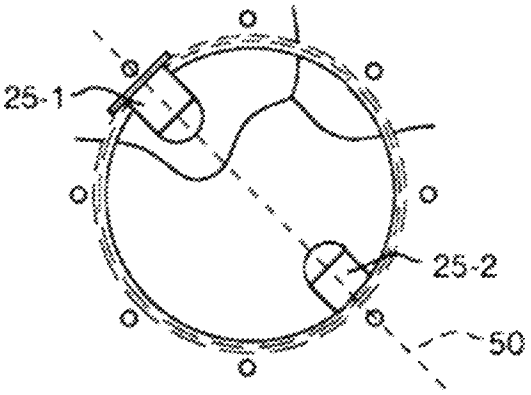
FIG. 3B is a cross-sectional view illustrating a waveguide having more than one insert elements, according to some non-limiting embodiments.
Figure 3A:
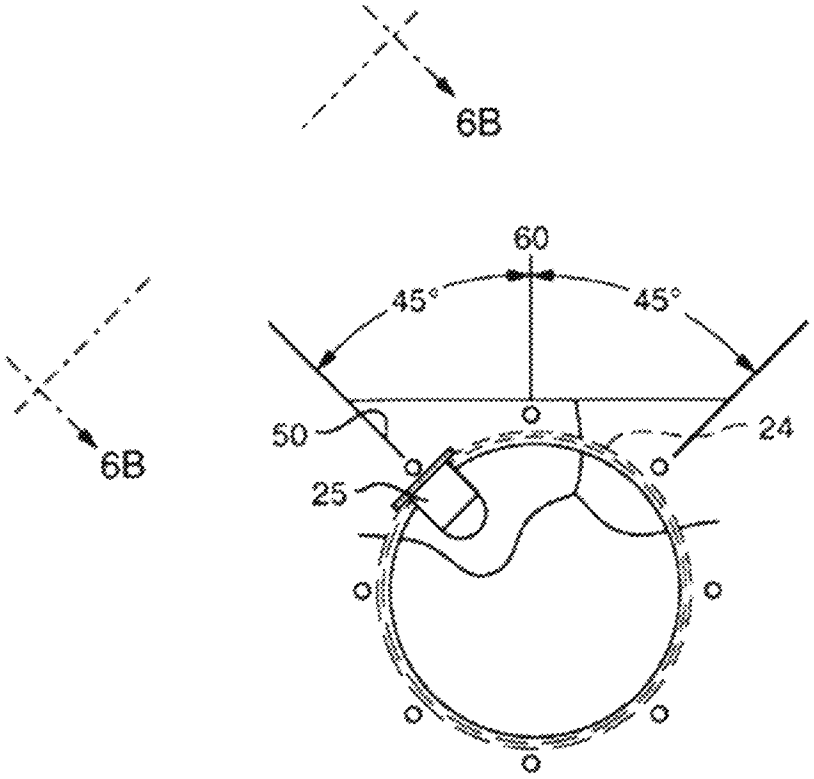
FIG. 3A is a cross-sectional view illustrating a waveguide having an insert element, according to some non-limiting embodiments.

FIG. 3A is a cross sectional view of section 24 showing the placement of the element 25. Element 25 may be placed within the interior of section 24. Element 25 may include a protrusion extending toward the interior of section 24. In some embodiments, element 25 may be mounted at a 45 degree angle with respect to vertical axis 60. As a result, the electromagnetic energy may be decomposed in one component that is parallel to the axis 50, and one component that is perpendicular to the axis 50.

FIG. 3B illustrates an alternate arrangement in which two elements 25-1 and 25-2 are used. In this embodiment, the elements 25-1 and 25-2 may be placed opposite one another along axis 50. The elements 25-1 and 25-2 may each be shorter in height than the single element 25 shown in FIG. 3A. This arrangement may provide for better impedance matching along the axis 50 by providing a more uniform structure along axis 50.

Figure 4C:
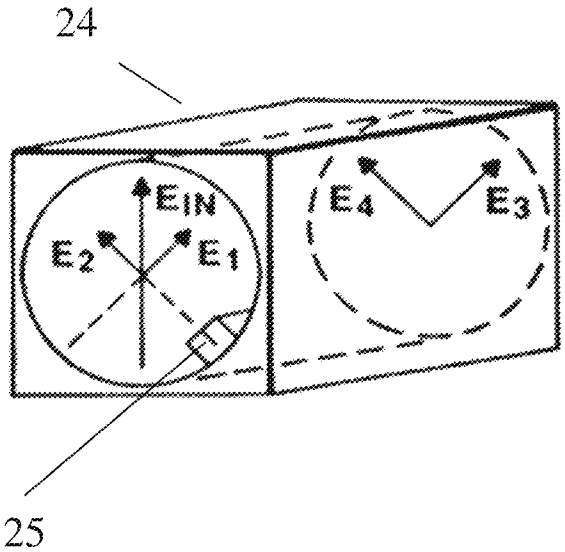
FIGS. 4A-4C are respective perspective views of a waveguide supporting a linearly polarized mode, a transformer, and a waveguide supporting a circularly polarized mode, according to some non-limiting embodiments.
Figure 4B:
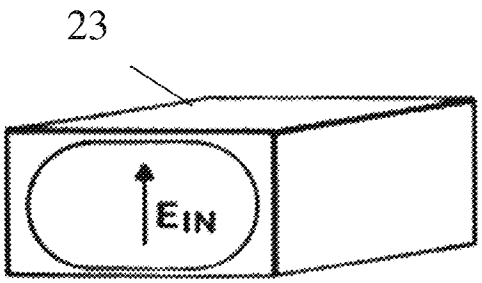
Figure 4A:
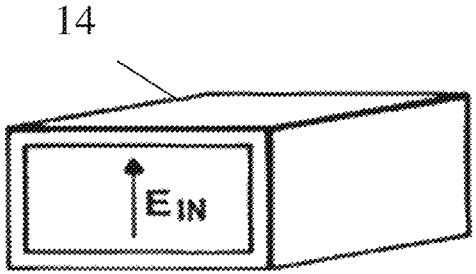

FIGS. 4A, 4B and 4C are schematic diagrams illustrating the polarization modes of waveguide 20. Waveguide 14 may exhibit electromagnetic energy in a linearly polarized mode $E_{in}$, which may be parallel to the minor dimension of the rectangular waveguide 14. Energy coupled through the transformer 23 may maintain this orientation throughout the transformer 23. At the output end of the transformer 23, corresponding to the input end of the section 24, the input field $E_{in}$ can be considered as the vector sum of two mutually perpendicular vectors $E_1$ and $E_2$, as shown in the diagram. $E_1$ may be perpendicular to axis 50 and $E_2$ may be parallel to axis 50. The output end of section 24 may exhibit the polarization vectors $E_3$ and $E_4$. In some embodiments, the length of element 25 along the propagation axis of section 24 is designed to phase shift the two components by approximately $\pi/2$ (or an odd integer multiple of approximately $\pi/2$) with respect to each other. In this way, $E_3$ and $E_4$ may collectively form a circularly polarized mode or an approximately circularly polarized mode (e.g., an elliptical mode whose minor axis is at least 90% of the major axis in length).

Figure 4D:
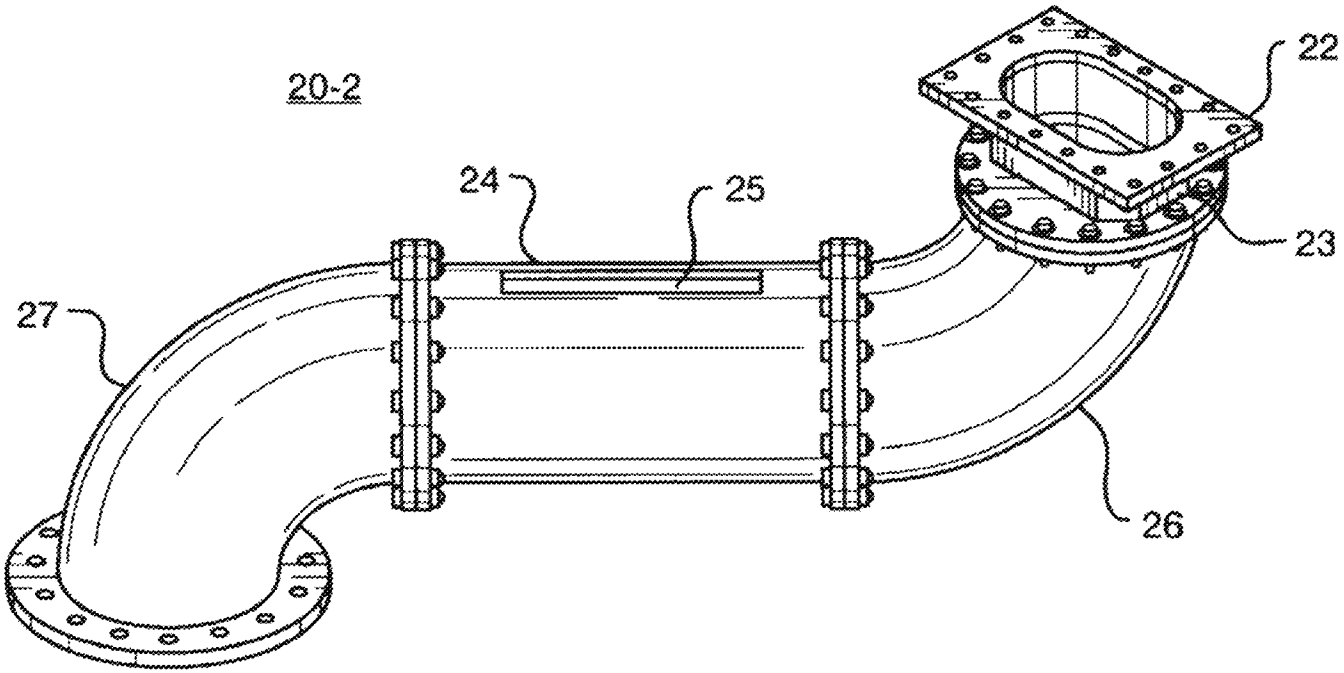
FIG. 4D is a perspective view illustrating a waveguide including a bent portion, according to some non-limiting embodiments.

As described in connection with FIG. 3A-3B, phase shifting of two linearly polarized components may be achieved using element 25, or elements 25-1 and 25-2. Such elements may have lengths sized to provide an approximately $\pi/2$ phase shift between the two linearly polarized components. In some embodiments, some or all the desired phase shift may be introduced using bent waveguide. As an electromagnetic wave travels through a bent waveguide, its wavefronts may be rearranged thus resulting in a phase shift. The use of bent waveguides may aid in providing the desired phase shift while reducing the length of section 24, thus reducing the overall size of a processing apparatus. FIG. 4D is a perspective view of a waveguide including a bent portion. Waveguide 20-2 may include section 24 and element 25, which have been described above. Additionally, or alternatively, waveguide 20-2 may include one or more bent portions, such as bent portions 26 and 27. Due to its asymmetry, a bent portion introduces a phase difference between the linearly polarized components of an electromagnetic wave that travels along its propagation axis. Therefore, bent portions may be used to achieve the desired phase difference to obtain a circular polarization. In some embodiments, one or more bent portions may operate in combination with element 25 to achieve the desired phase shift. As further illustrated in FIG. 4D, bent portion 26 may be connected to a flange 22 and a transformer 23.

Figure 5A:
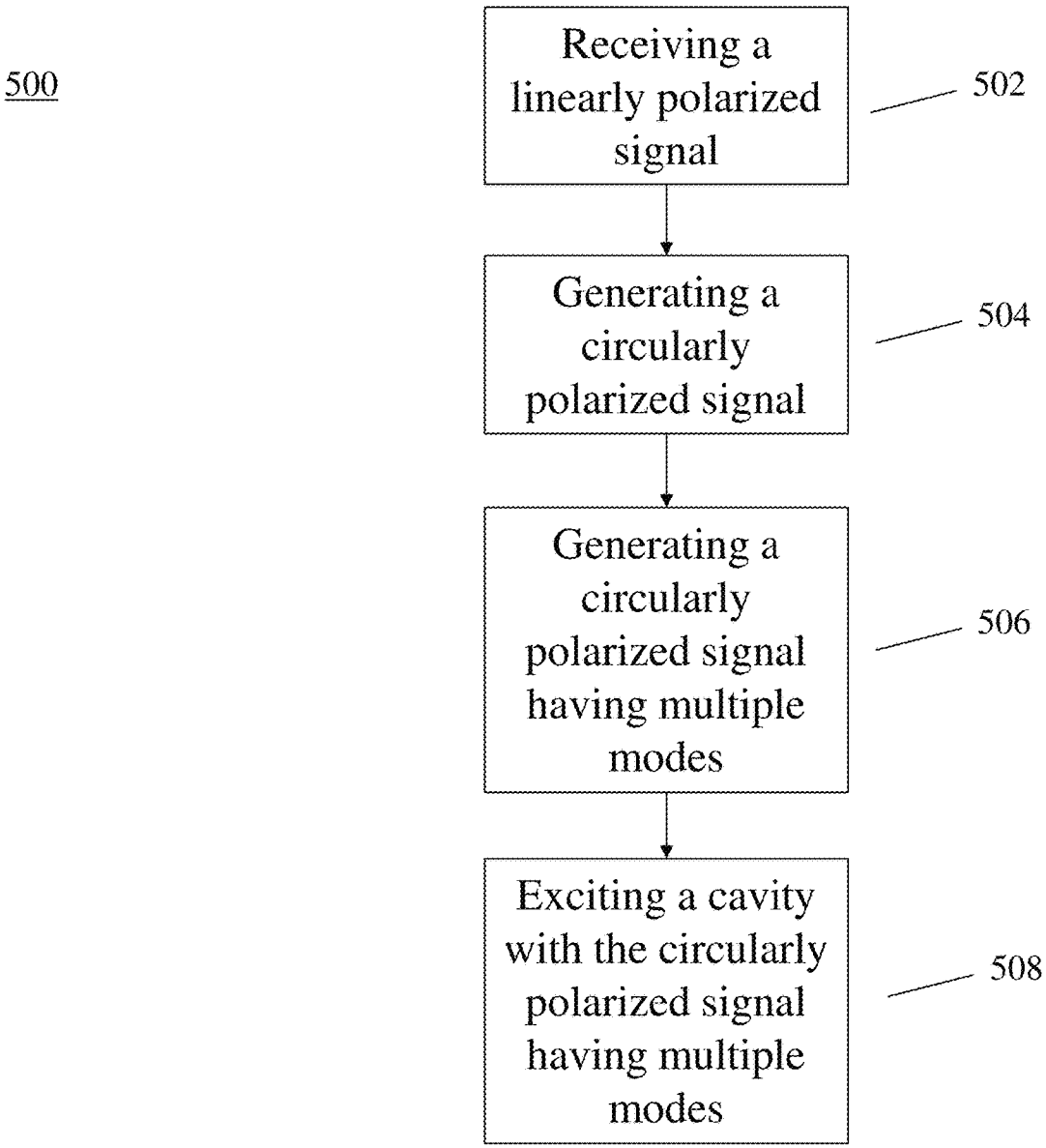
FIG. 5A is a flow chart illustrating a method for generating a circularly polarized signal having multiple modes, according to some non-limiting embodiments.

FIG. 5A is a block diagram illustrating a method 500 for exciting a cavity with electromagnetic radiation using a resonant antenna, which may be implemented in some embodiments. At block 502, an electromagnetic field having a linearly polarized mode may be received, such as by being received at a waveguide from a microwave generator or other source of microwave energy. The linearly polarized mode may be provided using a waveguide, such as waveguide 14 of FIG. 2A. At block 504, a circularly polarized mode may be generated from the linearly polarized mode. The circularly polarized mode may be generated by phase shifting two orthogonal components of the linearly polarized mode by approximately $\pi/2$ with respect to one another. This may be achieved, for example, using the structures described in connection with FIGS. 3A-4C. At block 506, a signal having multiple circularly polarized modes may be generated. Such a signal may be generated using a resonant antenna in accordance with some embodiments described above. At block 508, a cavity may be excited by leaking a portion of the electromagnetic energy resonating within the antenna. In some embodiments, such a portion may be leaked using one or more apertures formed on a surface of the antenna.

Figure 5B:
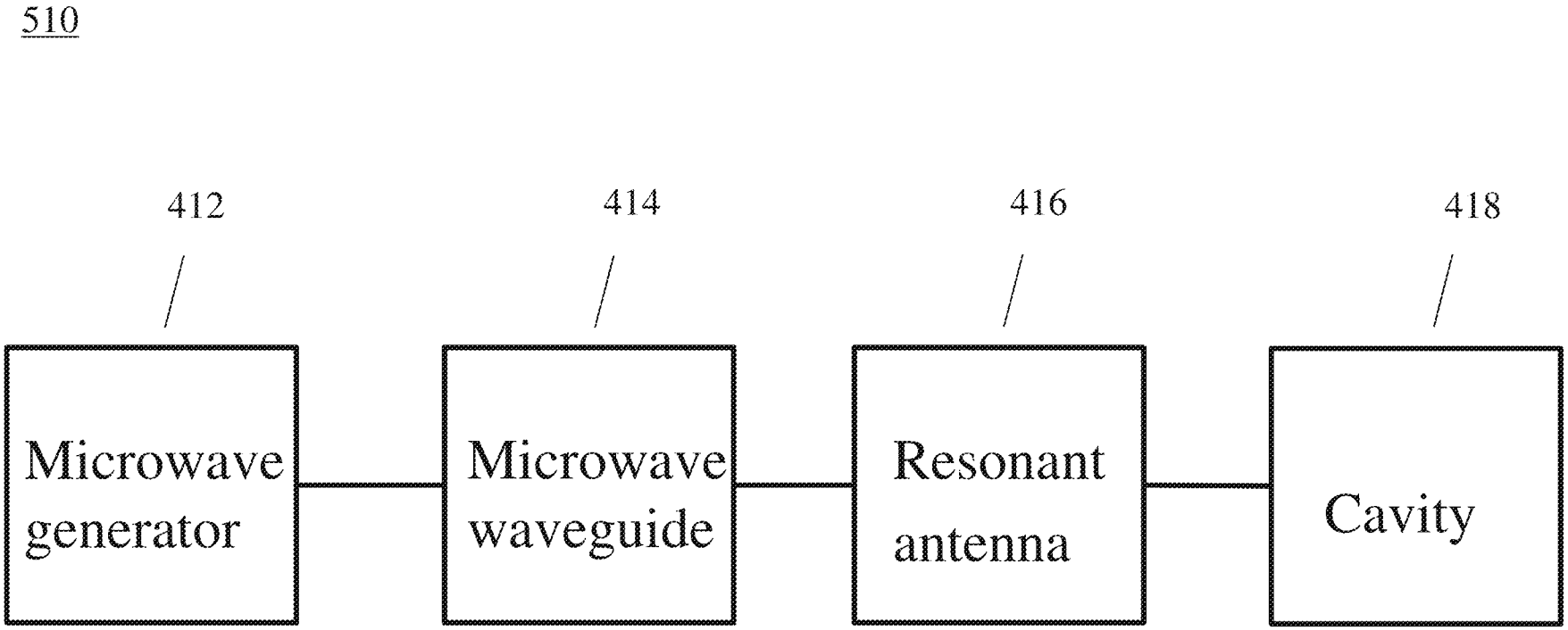
FIG. 5B is a block diagram illustrating an apparatus for exciting a cavity with a circularly polarized signal having multiple modes, according to some non-limiting embodiments.

FIG. 5B illustrates an example of a signal path associated with method 500. An electromagnetic signal may be generated using a microwave generator. In some embodiments, the electromagnetic signal may be generated in an ISM band, such as in the 902 MHz-928 MHz band, or in the 2.4 GHz-2.5 GHz band. The generated electromagnetic signal may be coupled to a microwave waveguide 414. Microwave waveguide 414 may include waveguide 14 and waveguide 20. Microwave waveguide 414 may support a circularly polarized mode. The circularly polarized mode may be coupled to resonant antenna 416, which may be implemented using resonant antenna 100. The resonant antenna may be used to transform a signal having one circularly polarized mode in one having multiple circularly polarized modes (e.g., two, three, four, five, six or any other suitable number of circularly polarized modes). A portion of the electromagnetic field resonating inside the resonant antenna may be coupled to a cavity, for example using one or more apertures formed on a surface of the antenna.

Figure 6:
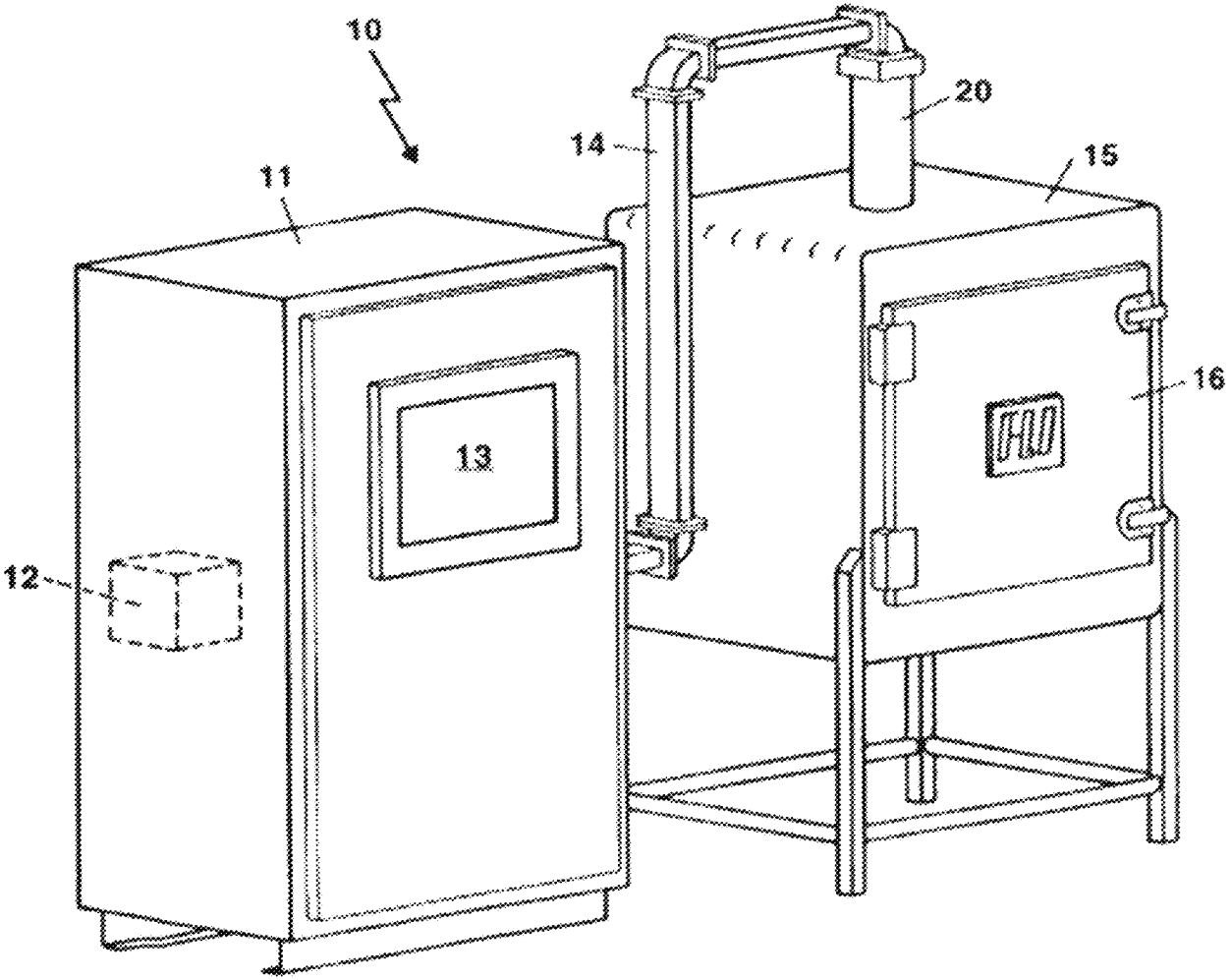
FIG. 6 is a perspective view of a batch type industrial grade microwave oven which makes use of a resonant antenna, according to some non-limiting embodiments.

As described above, resonant antennas of the type described herein may be used in some embodiments in connection with microwave ovens for heating and/or cooking food items. FIG. 6 illustrates a microwave oven 10 which may be used in processing industrial applications. The microwave oven 10 may include a cabinet 11 which may enclose a microwave energy source 12. Microwave energy source 12 may serve as microwave generator 412. A control panel 13, disposed on the outer surface of the cabinet 11, may include a control interface. Waveguides 14 and 20 may provide microwave energy from the energy source 12 to the interior of an oven cavity 15. A door assembly 16 may provide access to the interior of oven cavity 15. A resonant antenna (not shown in FIG. 6) may be disposed inside oven cavity 15 and may be configured to receive a circularly polarized mode from waveguide 20. In response, the resonant antenna may generate multiple circularly polarized modes, and may electromagnetically excite the interior of the oven cavity.

Figure 7A:
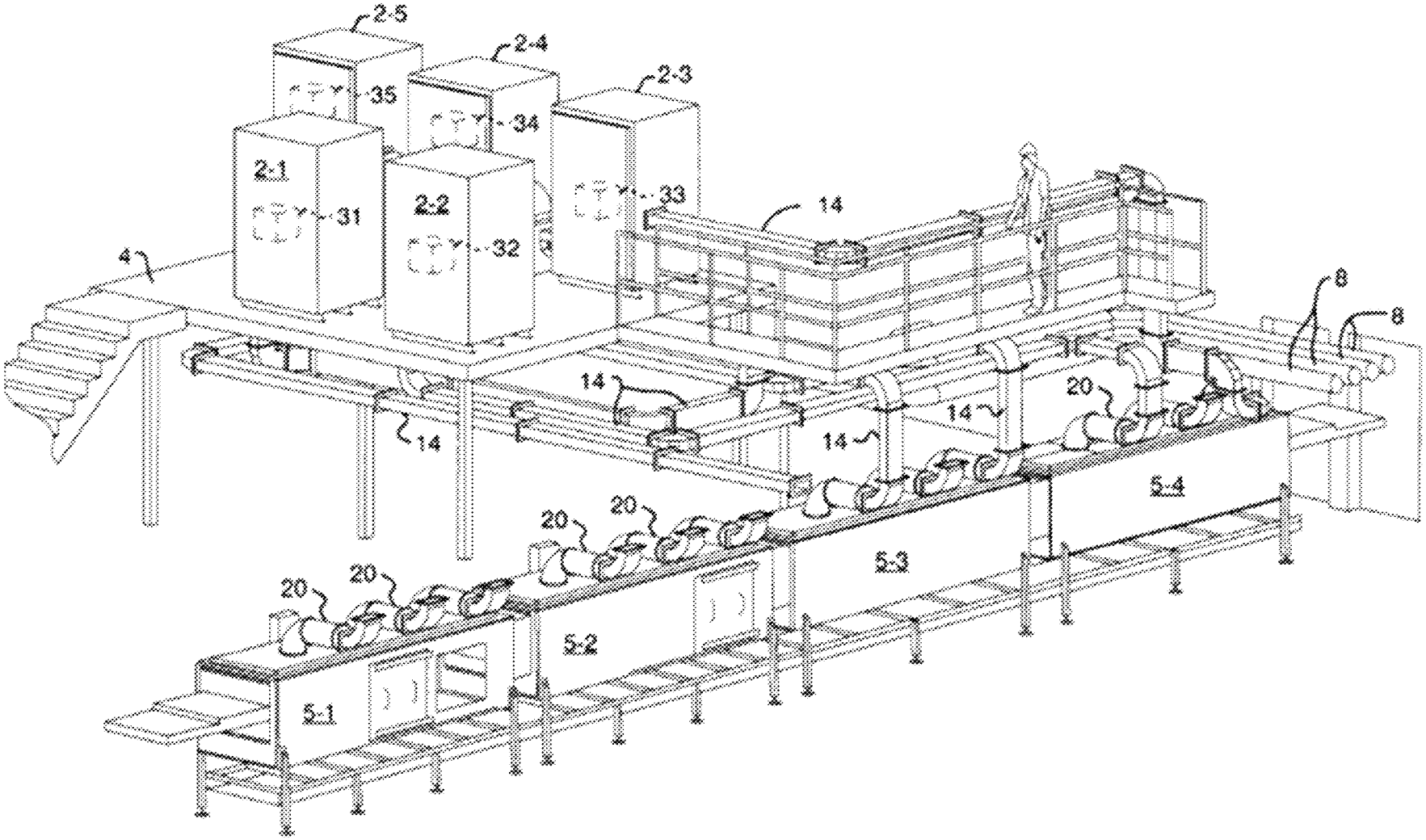
FIG. 7A is a partial perspective view of a single-belt continuous feed type oven that makes use of a resonant antenna, according to some non-limiting embodiments.

In some embodiments, multiple cavities of the type described herein may be used to process (e.g., heat or cook) items disposed inside the cavities. FIG. 7A illustrates an oven system 1, which may be used in continuous feed industrial applications. The oven system 1 may include one or more resonant antennas 100. The oven system 1 may include a number of equipment cabinets 2-1, 2-2, . . . , 2n, some or all of which may enclose a microwave energy sources 3. The cabinets 2 may be supported by one or more floors 4 located above a series of individual oven cavities 15-1, 15-2, 15-3, and 15-4. In the non-limiting examples of FIG. 7A, system 1 includes twelve cabinets supported on two different floors. For the sake of clarity, only one of the floors 4 and some of the cabinets 2 are shown. However, system 1 is not limited to any specific number of cabinets or floors. The oven cavities 15 may be arranged in series such that product to be processed is fed from one oven to the next. A conveyer belt 17 may be used for holding the product in place as it is processed through the various oven cavities in series. One or more door assemblies 16 may provide access to the interior of a respective enclosure oven cavity. Vents 18 may provide an avenue for steam generated during the cooking/heating process to escape from the oven cavities 15. Some or all of the oven cavities 15 may include one or more resonant antennas 100, as illustrated in FIG. 1D.

Figure 7B:
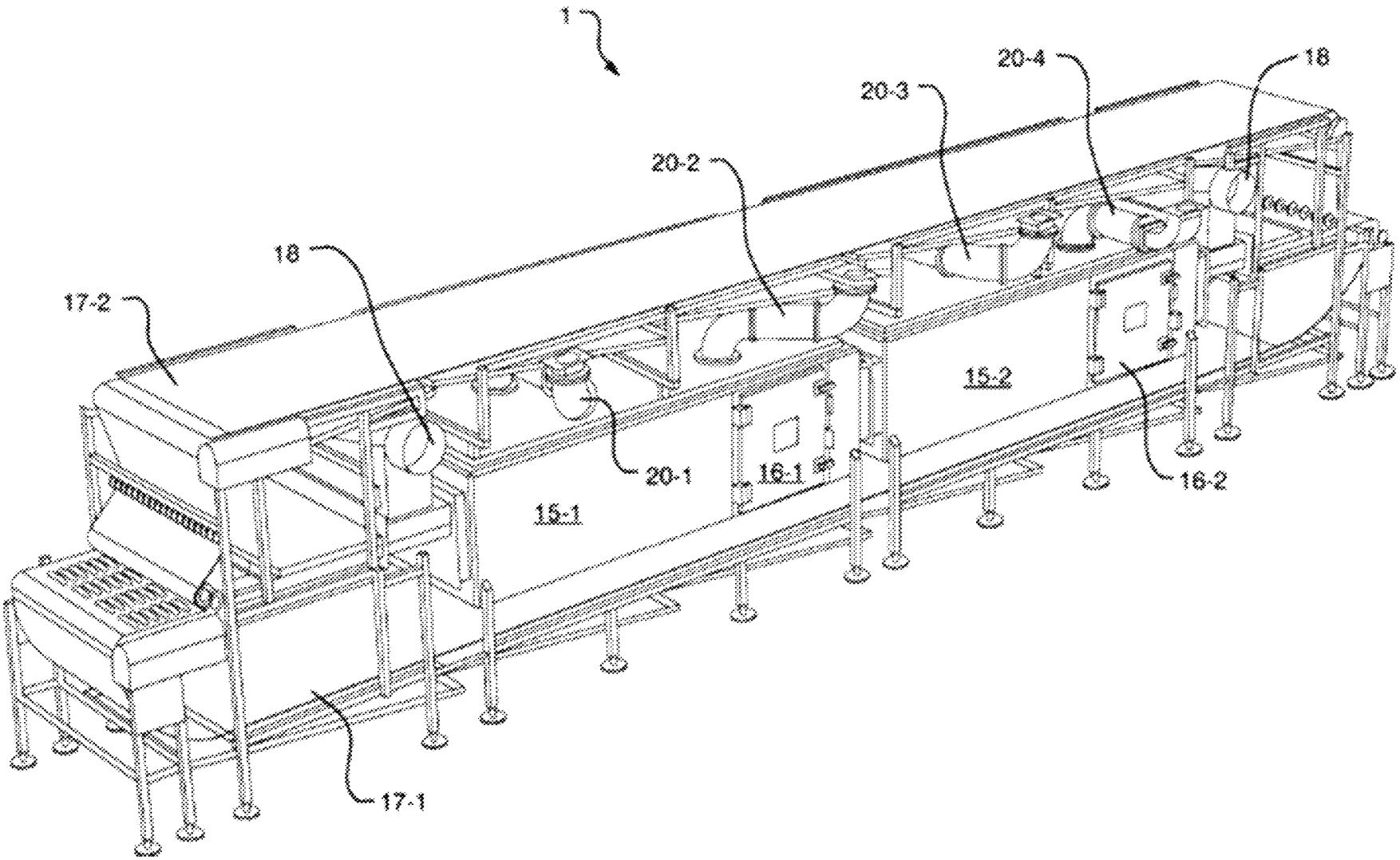
FIG. 7B is a partial perspective view of a two-belt continuous feed type oven that makes use of a resonant antenna, according to some non-limiting embodiments.

FIG. 7B illustrates a portion of an oven system in additional detail. As illustrated, oven system 1 includes two oven cavities 15-1 and 15-2 and waveguides 20-1, 20-2, 20-3 and 20-4. The waveguides may each be coupled to a resonant antenna 100 disposed in a corresponding oven cavity. Orientation of the waveguides 20 may be constrained by the use of a pair conveyer belts, namely an upper 17-1 and lower belt 17-2. Certain applications, such as the cooking of bacon, may require two belts to hold the product flat while processing.

Various aspects of the embodiments described above may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Having thus described several aspects of at least one embodiment, it is to be appreciated that various alterations, modifications, and improvements will readily occur to those skilled in the art. Such alterations, modifications, and improvements are intended to be part of this disclosure, and are intended to be within the spirit and scope of the principles described herein. Accordingly, the foregoing description and drawings are by way of example only.

What is claimed is:

1. An apparatus comprising:

a microwave antenna comprising:

a three-dimensional resonant chamber to generate, from an input microwave signal having a circularly polarized mode, an output microwave signal having a plurality of circularly polarized modes, wherein the three-dimensional resonant chamber has a cylindrical shape, wherein the three-dimensional resonant chamber comprises a top wall, a bottom wall and a sidewall connecting the top wall to the bottom wall, wherein the top wall comprises an opening to connect to a waveguide configured to provide the input microwave signal to the three-dimensional resonant chamber, and wherein the bottom wall is electrically closed; and at least one aperture, formed on the sidewall of the three-dimensional resonant chamber, to couple the output microwave signal having the plurality of circularly polarized modes to an outside of the three-dimensional resonant chamber.

2. The apparatus of claim 1, wherein the output microwave signal has a first circularly polarized mode and a second circularly polarized mode, the first circularly polarized mode being a $T_{11}$-mode, and the second circularly polarized mode being a $T_{21}$-mode.

3. The apparatus of claim 1, wherein the three-dimensional resonant chamber is, apart from the at least one aperture, electrically closed.

4. The apparatus of claim 3, wherein the three-dimensional resonant chamber comprises a solid outer surface.

5. The apparatus of claim 1, wherein the three-dimensional resonant chamber is configured to support two circularly polarized modes for at least some frequencies in an ISM band.

6. The apparatus of claim 5, wherein the ISM band comprises frequencies between 902 MHz and 928 MHz.

7. The apparatus of claim 1, wherein the at least one aperture is slanted by an angle that is between 25° and 75° with respect to a plane defined by the bottom wall of the three-dimensional resonant antenna.

8. The apparatus of claim 1, wherein the waveguide has a curved cross section.

9. The apparatus of claim 8, further comprising a rectangular waveguide coupled to the waveguide having the curved cross section, wherein the waveguide having the curved cross section electrically couples the rectangular waveguide to the three-dimensional resonant chamber.

10. The apparatus of claim 1, wherein the waveguide comprises an element for phase shifting a first component of a linearly polarized mode from a second component of the linearly polarized mode.

11. The apparatus of claim 1, wherein the microwave antenna is disposed within an electrically conductive cavity.

12. The apparatus of claim 11, wherein the electrically conductive cavity comprises a microwave oven for processing food.

13. The apparatus of claim 11, wherein the at least one aperture formed on the sidewall of the three-dimensional resonant chamber is aligned with an opening formed on the electrically conductive cavity.

14. An apparatus comprising:

a cavity, and an antenna disposed within the cavity to receive an input microwave signal having a circularly polarized mode, the antenna comprising a three-dimensional resonant chamber to generate, based on the input microwave signal, an output microwave signal having a plurality of circularly polarized modes and to couple the output microwave signal to the cavity, and wherein:

the three-dimensional resonant chamber has a cylindrical shape;

the three-dimensional resonant chamber comprises a top wall, a bottom wall and a sidewall connecting the top wall to the bottom wall;

at least one aperture is formed on the sidewall;

the top wall comprises an opening to connect to a waveguide configured to provide the input microwave signal to the three-dimensional resonant chamber; and the bottom wall is electrically closed.

15. An apparatus comprising:

a cavity; and a microwave antenna disposed in the cavity, the microwave antenna comprising:

a three-dimensional resonant chamber to generate an output microwave signal having a plurality of circularly polarized modes at least in part by resonating in response to input to the three-dimensional resonant chamber of an input microwave signal having a circularly polarized mode, wherein the three-dimensional resonant chamber has a cylindrical shape, wherein the three-dimensional resonant chamber comprises a top wall, a bottom wall and a sidewall connecting the top wall to the bottom wall, wherein the top wall comprises an opening to connect to a waveguide configured to provide the input microwave signal to the three-dimensional resonant chamber, and wherein the bottom wall is electrically closed; and at least one aperture, formed on the sidewall of the three-dimensional resonant chamber, to couple the output microwave signal having the plurality of circularly polarized modes to an inside of the cavity.

16. The apparatus of claim 15, wherein:

the three-dimensional resonant chamber is arranged to generate an output microwave signal having a first circularly polarized mode and a second circularly polarized mode of the plurality of circularly polarized modes;

the first circularly polarized mode is a $T_{11}$-mode; and the second circularly polarized mode is a $T_{21}$-mode.

17. The apparatus of claim 15, wherein the three-dimensional resonant chamber is, apart from the at least one aperture, electrically closed.

18. The apparatus of claim 17, wherein the three-dimensional resonant chamber comprises a solid outer surface.

19. The apparatus of claim 15, wherein the waveguide has a curved cross section.

20. The apparatus of claim 19, further comprising a rectangular waveguide coupled to the waveguide having the curved cross section, wherein the waveguide having the curved cross section electrically couples the rectangular waveguide to the three-dimensional resonant chamber.

* * * * *